US009685250B2

(12) United States Patent
Jung et al.

(10) Patent No.: US 9,685,250 B2
(45) Date of Patent: Jun. 20, 2017

(54) METHOD OF PREPARING RADIOISOTOPE HYBRID NANOCOMPOSITE PARTICLES USING SOL-GEL REACTION AND RADIOISOTOPE HYBRID NANOCOMPOSITE PARTICLES PREPARED USING THE SAME

(71) Applicant: Korea Atomic Energy Research Institute, Daejeon (KR)

(72) Inventors: Sung-Hee Jung, Daejeon (KR); Sun Ju Choi, Daejeon (KR); Jong Bum Kim, Daejeon (KR); Jin Ho Moon, Daejeon (KR); Seong Ho Choi, Daejeon (KR); Sang Ei Seo, Yeongdong-gun (KR)

(73) Assignee: Korea Atomic Energy Research Institute, Daejeon (KR)

( * ) Notice: Subject to any disclaimer, the term of this patent is extended or adjusted under 35 U.S.C. 154(b) by 166 days.

(21) Appl. No.: 14/476,601

(22) Filed: Sep. 3, 2014

(65) Prior Publication Data

US 2015/0064108 A1 Mar. 5, 2015

(30) Foreign Application Priority Data

Sep. 3, 2013 (KR) ..... 10-2013-0105666

(51) Int. Cl.

| | |
|---|---|
| ***G21G 1/00*** | (2006.01) |
| ***G21H 5/02*** | (2006.01) |
| *G21G 1/08* | (2006.01) |

(52) U.S. Cl.

CPC ..... *G21H 5/02* (2013.01); *G21G 1/08* (2013.01)

(58) Field of Classification Search

CPC ..... G21G 1/00; A61K 51/00

See application file for complete search history.

(56) References Cited

U.S. PATENT DOCUMENTS

2003/0180780 A1* 9/2003 Feng ..... G01N 33/587 435/6.12
2013/0087748 A1* 4/2013 Jung ..... B05D 1/00 252/625

FOREIGN PATENT DOCUMENTS

JP 2007-526471 A 9/2007
KR 10-2010-0034499 A 4/2010

OTHER PUBLICATIONS

Sung-Hee Jung et al., Preparation of radioactive core-shell type 198Au@SiO2 nanoparticles as a radiotracer for industrial process applications, Applied Radiation and Isotopes, 68, 1025-1029, 2010.*

Conroy Sun et al., Facile Synthesis of Amine-Functionalized Eu3+-Doped La(OH)3 Nanophosphors for Bioimaging, Nanoscale Res. Lett, 2011, 6, 24.*

Office Action dated Sep. 26, 2014 of corresponding Korean Patent Application No. 10-2013-0105666—4 pages.

* cited by examiner

*Primary Examiner* — Michael G Hartley
*Assistant Examiner* — Jagadishwar Samala
(74) *Attorney, Agent, or Firm* — Knobbe Martens Olson & Bear LLP

(57) ABSTRACT

A method of preparing radioisotope hybrid nanocomposite particles using a sol-gel reaction, and radioisotope hybrid nanocomposite particles prepared using the same are provided. The method includes preparing a complex precursor using a metal ion and an unshared electron pair reactive compound, growing hybrid nanocomposite particles based on the complex precursor by means of a sol-gel reaction, calcining the nanocomposite particles in the air to remove organic matters present in the nanocomposite particles, and irradiating the nanocomposite particles with neutrons to prepare radioisotope hybrid nanocomposite particles. The radioisotope nanocomposite particles prepared using the method can be used as diagnostic and therapeutic particles in the fields of oil refining, chemistry, cement, agriculture, water resources, environment, ocean, and medicine, and can also be used as a radioisotope tracer for evaluating the risk of nanomaterials.

7 Claims, 9 Drawing Sheets

METHOD OF PREPARING RADIOISOTOPE HYBRID NANOCOMPOSITE PARTICLES USING SOL-GEL REACTION AND RADIOISOTOPE HYBRID NANOCOMPOSITE PARTICLES PREPARED USING THE SAME

CROSS-REFERENCE TO RELATED APPLICATION

This application claims priority to and the benefit of Korean Patent Application No. 2013-0105666, filed on Sep. 3, 2013, the disclosure of which is incorporated herein by reference in its entirety.

BACKGROUND

1. Field

The present disclosure relates to a method of preparing radioisotope hybrid nanocomposite particles using a sol-gel reaction, and radioisotope hybrid nanocomposite particles prepared using the same.

2. Discussion of Related Art

Among isotopes, the isotopes producing radioactivity is referred to as "radioactive isotope" or "radioisotopes (RIs)." Among approximately 300 natural isotopes, there are approximately 40 radioisotopes. Most of the 40 radioisotopes are isotopes of elements having a higher atomic number than thallium. In recent years, approximately 1,000 artificial radioisotopes have been synthesized besides the natural radioisotope, and are distributed to cover almost all kinds of elements.

SUMMARY

It is an aspect of the present invention to provide a method of preparing a radioisotope hybrid which is able to be mass-produced using a simple manufacturing process, and a radioisotope metal oxide hybrid nanocomposite prepared using the method, which has a spherical shape and is physically and chemically stable.

However, the technical aspects of the present invention are not limited thereto, and other aspects of the present invention which are not disclosed herein will become more apparent to those of ordinary skill in the art by describing in detail exemplary embodiments thereof.

According to an aspect of the present invention, there is provided a method of preparing radioisotope hybrid nanocomposite particles. Here, the method includes:

(a) preparing a primary precursor by mixing a reactive compound with a metal ion and stirring the mixture;

(b) preparing hybrid nanocomposite particles by subjecting the primary precursor to a sol-gel reaction;

(c) calcining the hybrid nanocomposite particles at 300° C. to 700° C. for 5 to 10 hours; and (d) preparing radioisotope hybrid nanocomposite particles by irradiating the calcined particles with neutrons.

According to one exemplary embodiment of the present invention, the sol-gel reaction may include:

(b-1) adding the primary precursor to a mixed solvent;

(b-2) adding tetraethoxysilane to the mixed solvent to which the primary precursor is added; and (b-3) preparing hybrid nanocomposite particles by stirring a solution to which the tetraethoxysilane is added in operation (b-2) for 6 to 9 hours.

According to another exemplary embodiment of the present invention, the reactive compound may be a compound having an unshared electron pair.

According to still another exemplary embodiment of the present invention, the reactive compound having an unshared electron pair may be 3-aminopropyltriethoxy silane, or 3-mercaptopropyltriethoxy silane.

According to still another exemplary embodiment of the present invention, the metal ion may be at least one selected from the group consisting of manganese (Mn), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), yttrium (Yb), and lutetium (Lu).

According to yet another exemplary embodiment of the present invention, the mixed solvent may include ethanol, an ammonia solution, and distilled water.

According to another aspect of the present invention, there is provided radioisotope hybrid nanocomposite particles prepared using the method.

According to one exemplary embodiment of the present invention, the radioisotope hybrid nanocomposite particles may be used as a radioisotope tracer.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
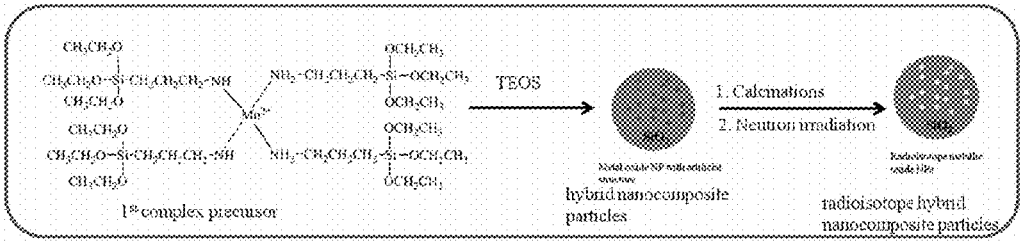
FIG. 1 is a diagram showing a method of preparing radioisotope hybrid nanocomposite particles using a sol-gel reaction.

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

In general, artificial radioisotopes are prepared by irradiating stabilized elements or compounds with radiations in a nuclear reactor or a particle accelerator, and have been widely used as a target for tracing the behaviors of elements or compounds in matters or living organisms, used to achieve an effect of radioactive irradiation on matters or living organisms, used as a radioactive source for an industrial or measuring purpose, or used to apply to the analysis of materials using radioactivity. Among theses, a radioisotope used to trace the behaviors of the elements or compounds is referred to as a radioisotope tracer, and radioactive tracer technology may be used to gentrify the analyses in industrial process in the fields of oil refining, chemistry, and cement, and also induce an epochal technological breakthrough in the fields of environment, medicine, agriculture, resource exploration, etc.

To makes effective use of such radioactive tracer technology, technology to prepare a radioisotope tracer is very important. Although there is a slight difference according to the fields used, a radioisotope tracer requires a characteristic in which an atomic nucleus is converted into another atomic nucleus as the atomic nucleus itself produces radiations without being affected by external environments such as externally applied pressure, temperature, chemical treatment, and the like. Also, the radioisotope tracer should have a density similar to a high-temperature and/or high-pressure fluid as well as chemical and physical stability to be used in the fluid. Such a radioisotope tracer may be mixed with a fluid and used as a radioactive tracer. Widely used radioisotopic chemicals, $^{198}$Au, $^{63}$Ni, $^{108}$Ag, $^{64}$Cu, $^{60}$Co, and the like, are metals that have very high density and specific gravity, and thus may not be used in the form of typical metal powder in an high-temperature and high-pressure industrial process fluid. Therefore, there is extensive research conducted to use the radioisotope tracer in the high-temperature and/or high-pressure fluid.

Meanwhile, a sol-gel method is a reaction in which an inorganic oxide having a 3D cross-linking structure is obtained at a low temperature through hydrolysis and condensation of precursor molecules. The hydrolysis and condensation rates in the sol-gel reaction are affected by pH, properties of a solvent, types of alcoxide precursors, and the like. Hybrid synthesis methods using a sol-gel reaction of tetraethoxysilane (TEOS) that is the most typical as a precursor of silica have been established for a long period of time, and extensive research for industrial applications and practical use has been currently conducted.

Sol-gel hybrid nanomaterials may maintain excellent thermal stability and high transparency due to the presence of inorganic matters formed by the sol-gel reaction. Also, the nanomaterials may adjust characteristics by forming a complex inorganic structure of various metal elements, and has an excellent transmittance of approximately 90% at a visible ray range (400 to 700 nm) and shows high transmissivity even when exposed to a high temperature of 150 to 200° C. for a long period of time. Therefore, the inorganic matters formed by the sol-gel reaction may have chemistry and physical stabilities in the high-temperature and high-pressure fluid, and may also be used to determine flow characteristics since they are easily mixed with the fluid when they are synthesized as nano-level fine particles.

Since the widely used radioisotopic chemicals are metals such as $^{198}$Au, $^{63}$Ni, $^{108}$Ag, $^{64}$Cu, $^{60}$Co, and the like, which have very high density and specific gravity, a metal powder itself cannot be used in the high-temperature and high-pressure fluid. Thus, a radioisotope nanocomposite having a core-shell structure for emitting nano-sized gamma (γ)-rays to use them in the high-temperature/high-pressure fluid was developed. Also, a method of synthesizing a two-nuclide nanocomposite having a core-shell structure is disclosed. However, the nanocomposite having a core-shell structure has problems in that a manufacturing process such as neutron irradiation is complicated, and it cannot be synthesized at a large scale.

Therefore, there is an urgent demand for development of radioactive tracers which are easily manufactured and physically and chemically stable.

To develop a radioisotope tracer which is physically and chemically stable and is easily dispersed in a fluid, the radioisotope tracer should be nano-sized, spherical and unreactive, and include a radioisotope metal. Accordingly, the present invention is directed to technology of preparing a radioisotope hybrid nanocomposite used in the radioisotope tracer technology, and, more particularly, to a method of preparing radioisotope hybrid nanocomposite particles, which is prepared using a simple manufacturing process, able to be mass-produced, nano-sided to facilitate dispersibility of the fluid, has a spherical shape, and is physically and chemically stable.

First of all, embodiments of the present invention provides a method of preparing radioisotope hybrid nanocomposite particles. Here, the method includes preparing a primary precursor by means of a complexation reaction between a metal ion and a 3-aminotriethoxysilane solution containing an unshared electron pair, adding tetraethoxysilane to the primary precursor, forming a secondary growth structure including the metal ion through a sol-gel reaction, calcining the secondary growth structure in the air to prepare hybrid nanocomposite particles including metal oxide nanoparticles, and irradiating the hybrid nanocomposite particles with neutrons to prepare the radioisotope hybrid nanocomposite particles.

Hereinafter, respective operations of the method according to embodiments of the present invention will be described in detail.

FIG. 1 is a diagram showing a method of preparing radioisotope hybrid nanocomposite particles. As shown in FIG. 1, embodiments of the present invention may provide a method of preparing radioisotope hybrid nanocomposite particles, which includes:

(a) preparing a primary precursor by mixing a reactive compound with a metal ion and stirring the mixture;

(b) preparing hybrid nanocomposite particles by subjecting the primary precursor to a sol-gel reaction;

(c) calcining the hybrid nanocomposite particles at 300° C. to 700° C. for 5 to 10 hours; and (d) preparing radioisotope hybrid nanocomposite particles by irradiating the calcined particles with neutrons.

In operation (c), the calcination temperature and time required to calcine the particles are not limited to these ranges. Preferably, the particles may be most completely calcined at 400° C. to 600° C. for 7 to 9 hours.

Also, the sol-gel reaction in operation (b) may include:

(b-1) adding the primary precursor to a mixed solvent;

(b-2) adding tetraethoxysilane to the mixed solvent to which the primary precursor is added; and (b-3) preparing hybrid nanocomposite particles by stirring a solution to which the tetraethoxysilane is added in operation (b-2) for 6 to 9 hours.

However, the sol-gel reaction is not limited to methods including the above-described operations, but may be performed in another solution rather than the tetraethoxysilane.

The metal ion used in operation (a) may be used without limitation as long as it is a metal ion. For example, the metal ion may be a rare earth metal such as manganese (Mn) or lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), yttrium (Yb), or lutetium (Lu), and, preferably, manganese, dysprosium, or samarium, as described in Examples of the present invention, but the present invention is not limited thereto.

The reactive compound used in operation (a) is characterized in that it has an unshared electron pair. As the reactive compound has the unshared electron pair, the reactive compound may form a complex with the metal ion at one electron, and may form particles at the other electron by means of a sol-gel reaction. Preferably, the reactive compound may be 3-aminopropyltriethoxy silane, or 3-mercaptopropyltriethoxy silane, but the present invention is not limited thereto. For example, compounds may be used without limitation as long as they can participate in the sol-gel reaction.

The mixed solvent used in operation (b-1) may include ethanol, an ammonia solution, or distilled water. In addition to the ethanol, ammonia solution, or distilled water, however, another solvent may be used to mix the primary precursor.

In Examples 1 to 3 of the present invention, it was confirmed that the prepared structure could be prepared with high yield using a simple method, compared with the conventional technology, by analyzing characteristics of the particles prepared by the method. Also, it was confirmed that the particles had a nano-sized spherical structure, and was physically and chemically stable.

Also, as seen from Examples of the present invention, it was revealed that the nanocomposite particles were able to be mass-produced since a metal was used at an amount of 1 to 5 g to prepare the nanocomposite particles, considering that the content of the metal used in the prior art was a unit of milligram (mg), which was different from a unit of gram (g) per se. Also, it was revealed that the nanocomposite particles had characteristics such as very short stirring and centrifugation times.

Accordingly, embodiments of the present invention provide radioisotope hybrid nanocomposite particles prepared by the method of preparing radioisotope hybrid nanocomposite particles. Here, the particles may be used as a radioisotope tracer, but present invention is not limited thereto.

Hereinafter, the present invention will be described with reference to the following Examples in order to facilitate a better understanding of the present invention. However, it should be understood that the following Examples are given by way of illustration of the present invention only, and are not intended to limit the scope of the present invention.

EXAMPLES

Example 1

Figure 2:
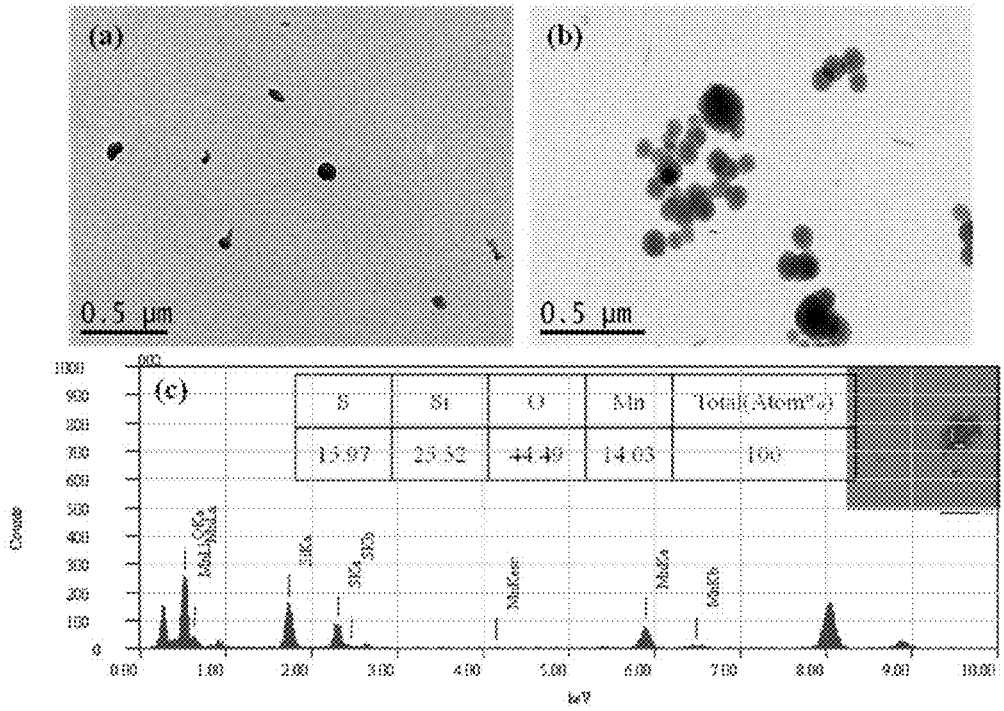
FIG. 2 shows TEM images and energy dispersive X-ray fluorescence spectroscopy (EDAX) of a primary complex precursor and a primary complex precursor of radioisotope hybrid $Mn@SiO_2$ nanocomposite particles.

Preparation and Determination of Radioisotope $Mn@SiO_2$ Nanocomposite Particles In a first operation, 5 mL of distilled water was put into a 50-mL beaker, and 1.6902 g of manganese sulfate was then dissolved in the distilled water. Thereafter, 18.64 mL of 3-aminotriethoxysilane was mixed with the resulting solution, and then stirred at room temperature for 3 hours to prepare a primary complex precursor. The primary complex precursor was analyzed using a transmission electron microscope (TEM) and energy dispersive X-ray fluorescence spectroscopy (EDAX). The analysis results are shown in FIG. 2.

From the results, it could be seen that the nano-sized precursor was prepared, as shown in FIG. 2A, and that manganese was included in the precursor, as shown in FIG. 2B.

In a second operation, 200 mL of ethanol, 4.0 mL of an ammonia solution, and 6.0 mL of distilled water were added to a 500-mL reaction container to prepare a mixed solvent. Thereafter, the primary complex precursor solution prepared in the first operation was added to and dispersed in the mixed solvent, and 15.0 mL of TEOS was then added, stirred at 3,000 to 4,000 rpm for 6 hours using a mechanical stirrer, and centrifuged to prepare hybrid nanocomposite particles.

In a third operation, the hybrid nanocomposite particles prepared in the second operation were calcined at 500° C. for 8 hours in a calciner while circulating the air to remove an organic compound present in the hybrid nanoparticles, thereby preparing hybrid $Mn@SiO_2$ nanocomposite particles. The prepared hybrid $Mn@SiO_2$ nanocomposite particles were analyzed using a TEM and an X-ray diffractometer (XRD).

Figure 3:
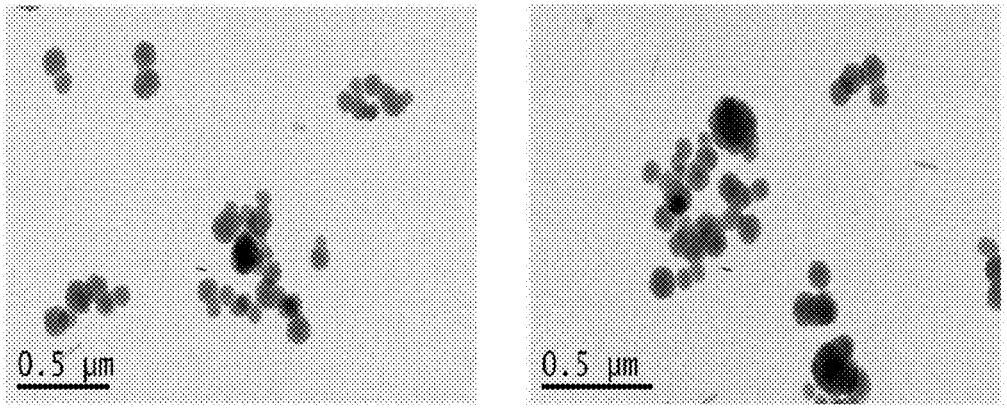
FIG. 3 shows TEM images of the radioisotope hybrid $Mn@SiO_2$ nanocomposite particles.
Figure 4:
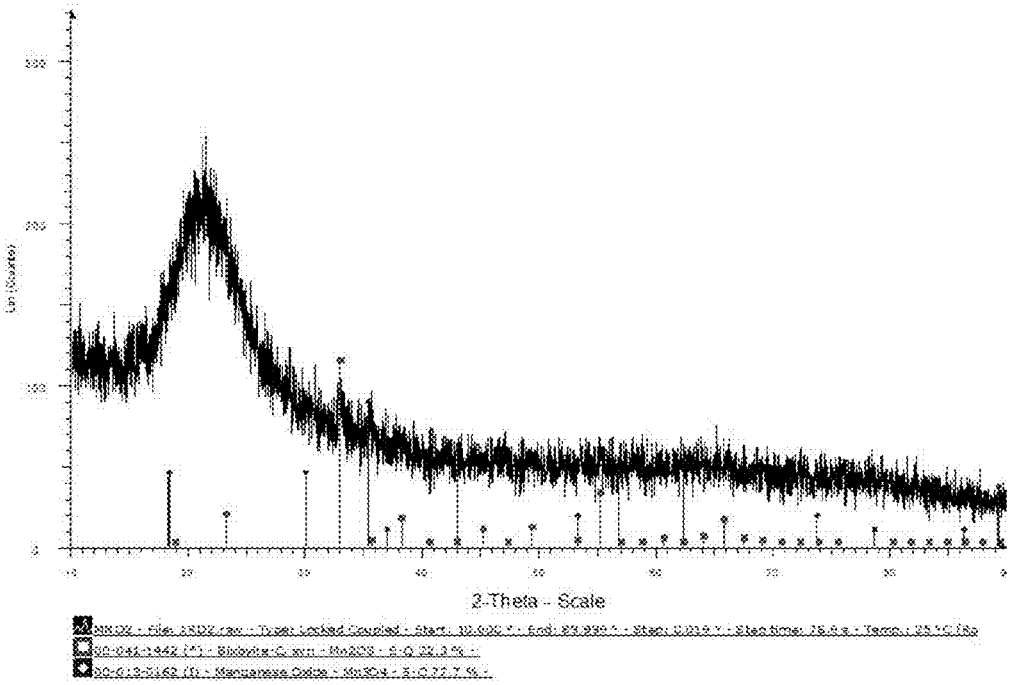
FIG. 4 shows the XRD spectra of the radioisotope hybrid $Mn@SiO_2$ nanocomposite particles.

As a result, it could be seen that the size of the particles grown in this third operation increased, as shown in FIG. 3. Also, it could be seen that the hybrid $Mn@SiO_2$ nanocomposite particles were formed as shown in FIG. 4.

In a fourth operation, the hybrid nanocomposite particles prepared in the third operation were irradiated with neutrons produced in a high flux advanced neutron application reactor (HANARO) that was a laboratory nuclear reactor to radiate Mn, thereby preparing radioisotope $Mn@SiO_2$ nanocomposite particles.

Figure 5:
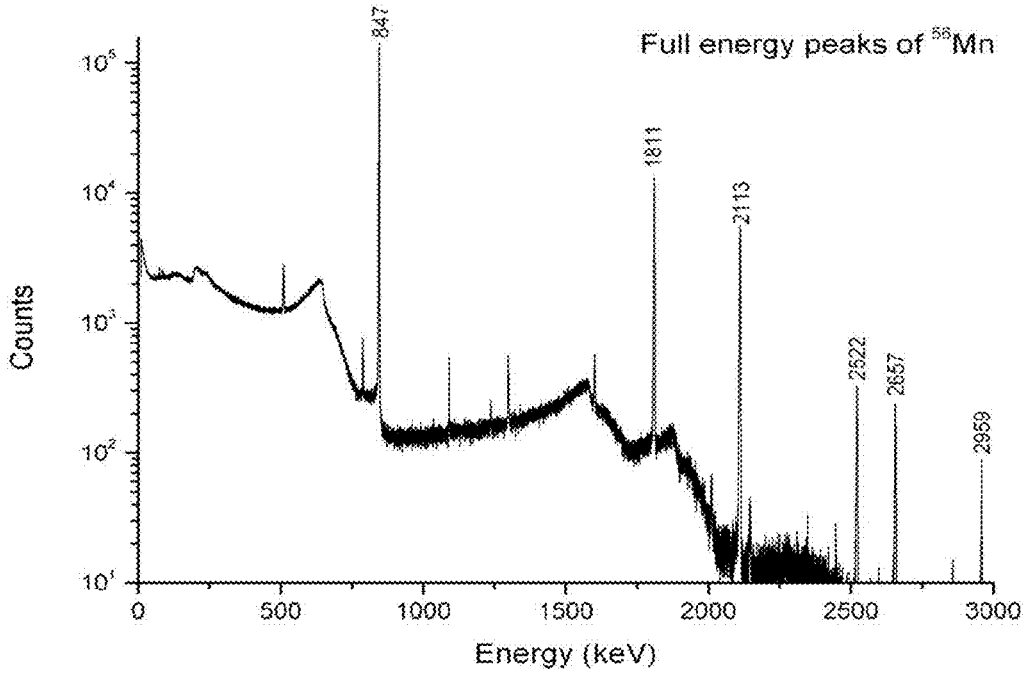
FIG. 5 shows the γ-ray spectra of the radioisotope hybrid $Mn@SiO_2$ nanocomposite particles.

As shown in FIG. 5, the γ-ray spectrum analysis showed that the radioisotope $Mn@SiO_2$ nanocomposite particles had a γ-ray energy of at least 847 KeV and up to 2,113 KeV, and that the radioisotope $Mn@SiO_2$ nanocomposite particles were successfully prepared.

Example 2

Figure 6:
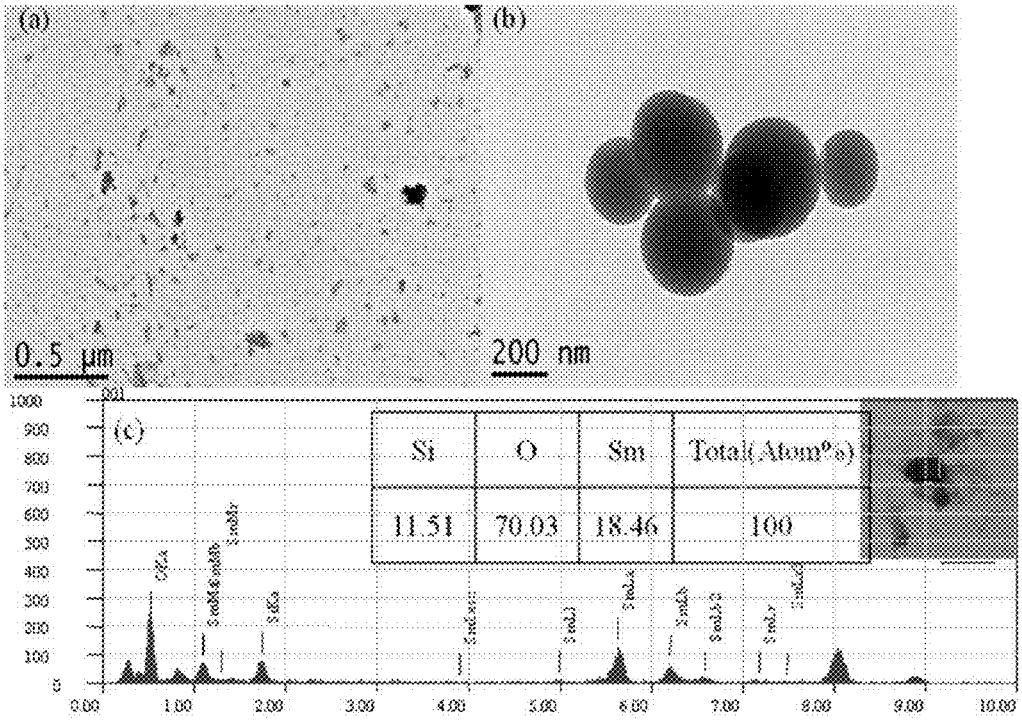
FIG. 6 shows TEM image and EDAX of a primary complex precursor and radioisotope hybrid $Sm@SiO_2$ nanocomposite particles.

Preparation and Determination of Radioisotope $Sm@SiO_2$ Nanocomposite Particles In a first operation, 5 mL of distilled water was put into a 50-mL beaker, and 4.444 g of samarium nitrate was then dissolved in the distilled water. Thereafter, 18.64 mL of 3-aminotriethoxysilane was mixed with the resulting solution, and then stirred at room temperature for 3 hours to prepare a primary complex precursor. The primary complex precursor was analyzed using a TEM and EDAX. The analysis results are shown in FIG. 6.

From the results, it could be seen that the nano-sized precursor was prepared, as shown in FIG. 6A, and that samarium was included in the precursor, as shown in FIG. 6B.

In a second operation, 200 mL of ethanol, 4.0 mL of an ammonia solution, and 6.0 mL of distilled water were added to a 500-mL reaction container to prepare a mixed solvent. Thereafter, the primary complex precursor solution prepared in the first operation was added to and dispersed in the mixed solvent, and 15.0 mL of TEOS was then added, stirred at 3,000 to 4,000 rpm for 6 hours using a mechanical stirrer, and centrifuged to prepare hybrid nanocomposite particles.

In a third operation, the hybrid nanocomposite particles prepared in the second operation were calcined at 500° C. for 8 hours in a calciner while circulating the air to remove an organic compound present in the hybrid nanoparticles, thereby preparing hybrid Sm@$SiO_2$ nanocomposite particles. The prepared hybrid Sm@$SiO_2$ nanocomposite particles were analyzed using a TEM and an XRD.

Figure 7:
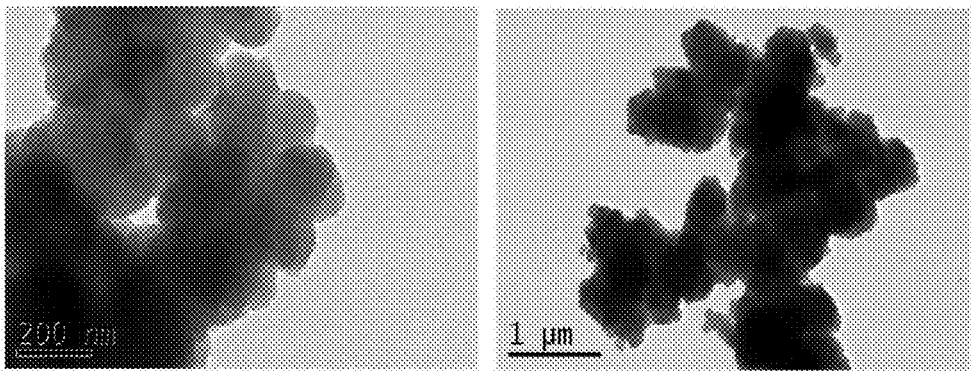
FIG. 7 shows TEM images of the radioisotope hybrid $Sm@SiO_2$ nanocomposite particles.
Figure 8:
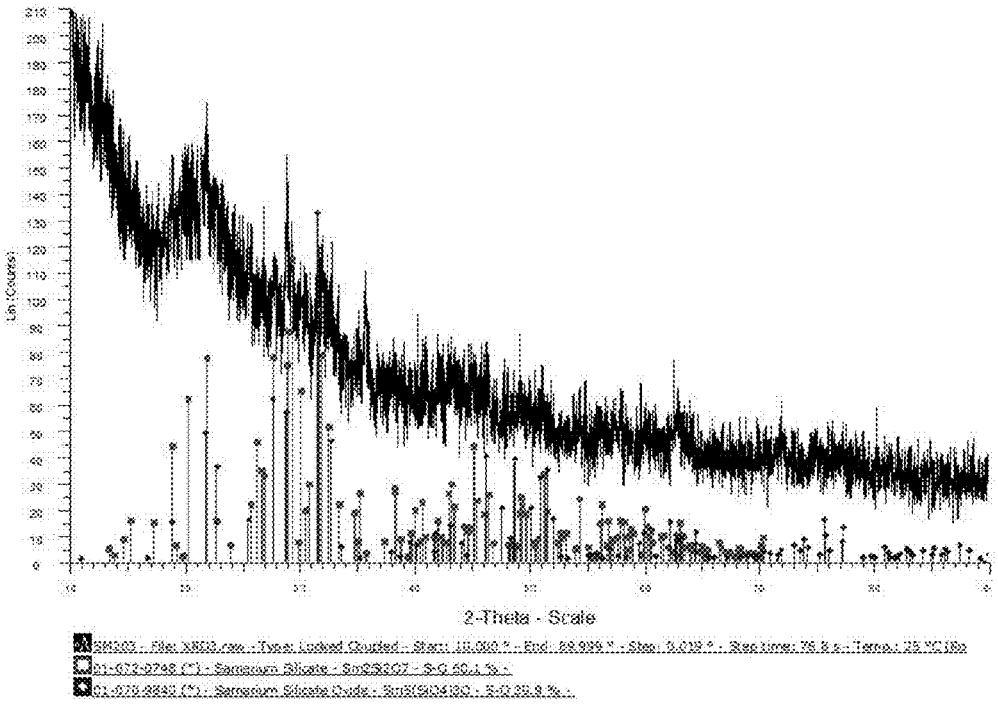
FIG. 8 shows the XRD spectra of the radioisotope hybrid $Sm@SiO_2$ nanocomposite particles.

As a result, it could be seen that the size of the particles grown in this third operation increased, as shown in FIG. 7. Also, it could be seen that the hybrid Sm@$SiO_2$ nanocomposite particles were formed as shown in FIG. 8.

In a fourth operation, the hybrid nanocomposite particles prepared in the third operation were irradiated with neutrons produced in a HANARO that was a laboratory nuclear reactor to radiate Sm, thereby preparing radioisotope Sm@$SiO_2$ nanocomposite particles.

Figure 9:
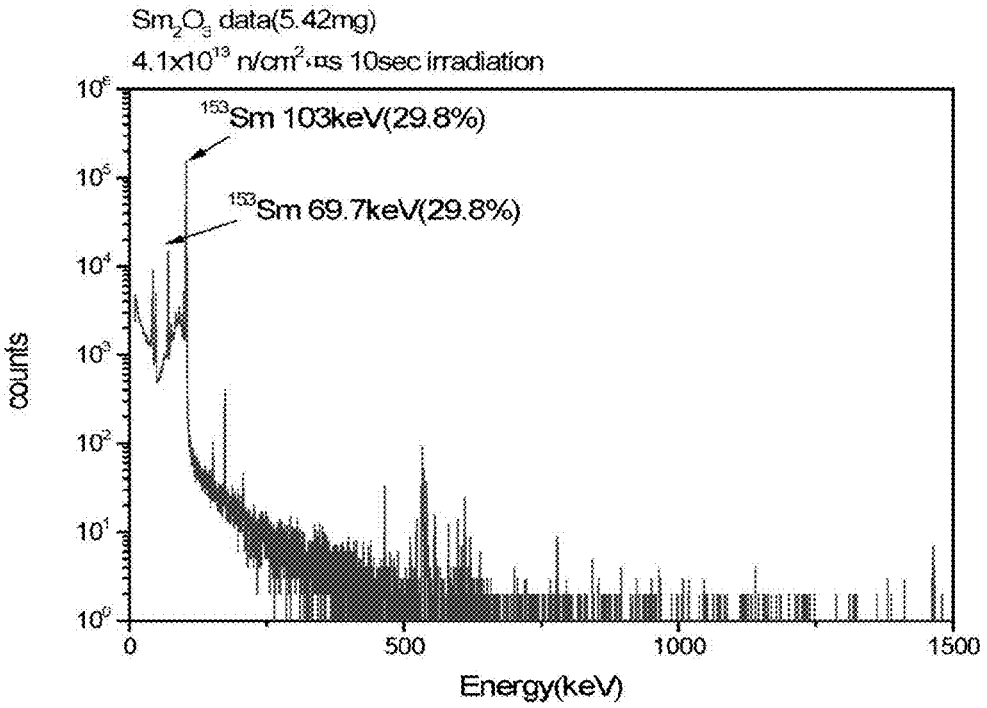
FIG. 9 shows the γ-ray spectra of the radioisotope hybrid $Sm@SiO_2$ nanocomposite particles.

As shown in FIG. 9, the γ-ray spectrum analysis showed that the radioisotope Sm@$SiO_2$ nanocomposite particles had a γ-ray energy of at least 69.7 KeV and up to 103 KeV, and that the radioisotope Sm@$SiO_2$ nanocomposite particles were successfully prepared.

Example 3

Figure 10:
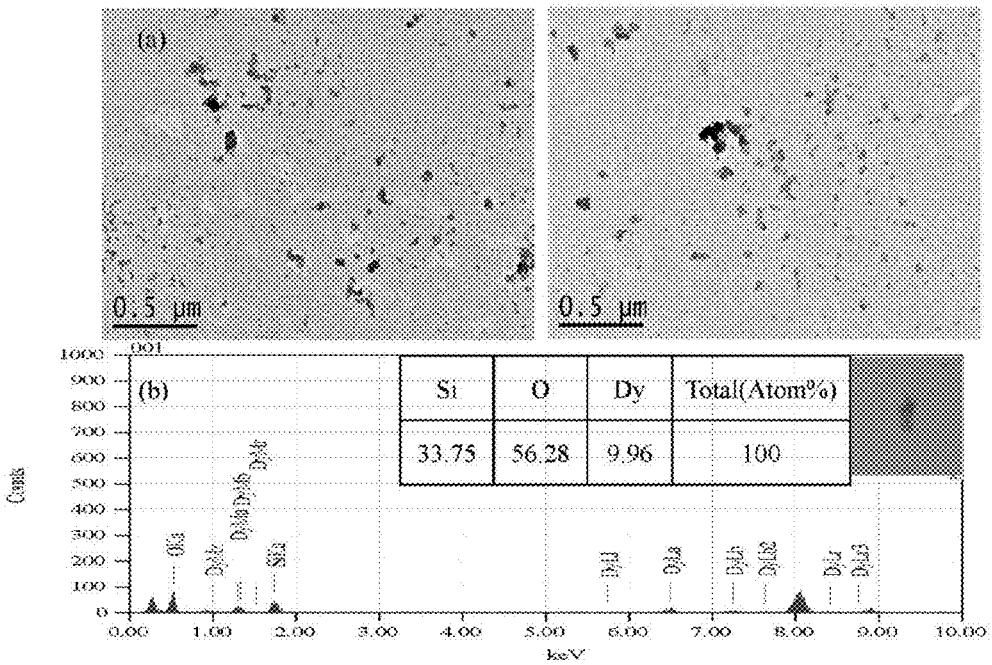
FIG. 10 shows TEM images and EDAX of a primary complex precursor and a primary growth structure of dioisotope hybrid $Dy@SiO_2$ nanocomposite particles.

Preparation and Determination of Radioisotope Dy@$SiO_2$ Nanocomposite Particles In a first operation, 5 mL of distilled water was put into a 50-mL beaker, and 3.485 g of dysprosium nitrate was then dissolved in the distilled water. Thereafter, 18.64 mL of 3-aminotriethoxysilane was mixed with the resulting solution, and then stirred at room temperature for 3 hours to prepare a primary complex precursor. The primary complex precursor was analyzed using a TEM and EDAX. The analysis results are shown in FIG. 10.

From the results, it could be seen that the nano-sized precursor was prepared, as shown in FIG. 10A, and that dysprosium was included in the precursor, as shown in FIG. 10B.

In a second operation, 200 mL of ethanol, 4.0 mL of an ammonia solution, and 6.0 mL of distilled water were added to a 500-mL reaction container to prepare a mixed solvent. Thereafter, the primary complex precursor solution prepared in the first operation was added to and dispersed in the mixed solvent, and 15.0 mL of TEOS was then added, stirred at 3,000 to 4,000 rpm for 6 hours using a mechanical stirrer, and centrifuged to prepare hybrid nanocomposite particles.

In a third operation, the hybrid nanocomposite particles prepared in the second operation were calcined at 500° C. for 8 hours in a calciner while circulating the air to remove an organic compound present in the hybrid nanoparticles, thereby preparing hybrid Dy@$SiO_2$ nanocomposite particles. The prepared hybrid Dy@$SiO_2$ nanocomposite particles were analyzed using a TEM and an XRD.

Figure 11:
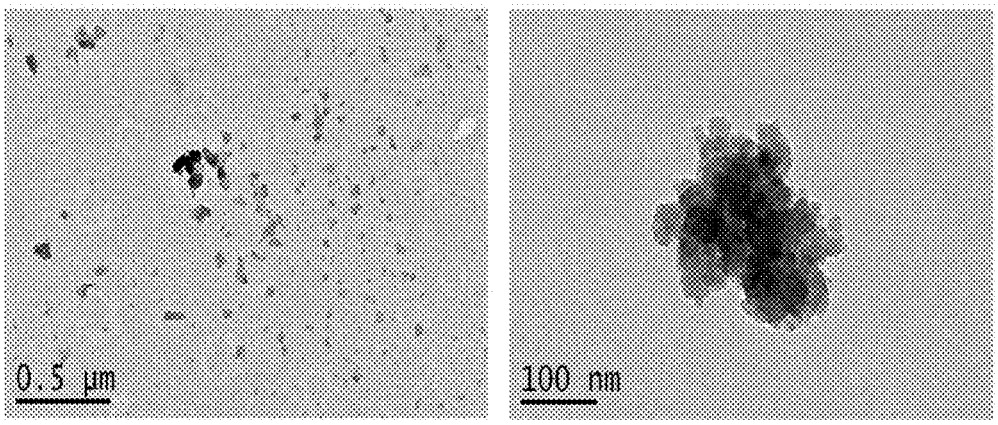
FIG. 11 shows TEM images of the radioisotope hybrid $Dy@SiO_2$ nanocomposite particles.
Figure 12:
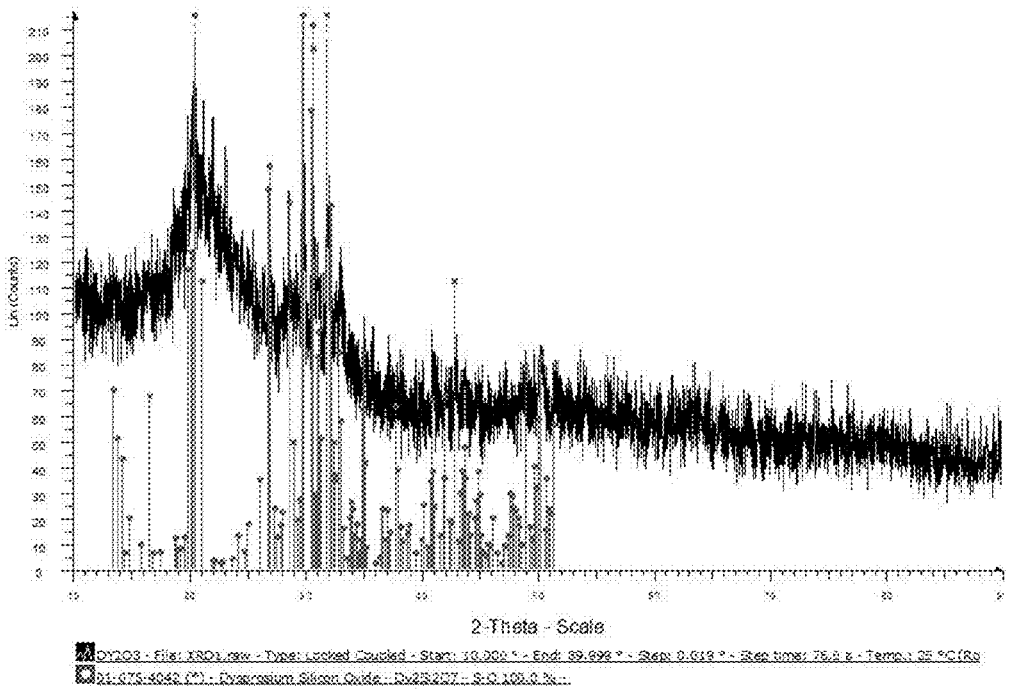
FIG. 12 shows the XRD spectra of the radioisotope hybrid $Dy@SiO_2$ nanocomposite particles.

As a result, it could be seen that the size of the particles grown in this third operation increased, as shown in FIG. 11. Also, it could be seen that the hybrid Dy@$SiO_2$ nanocomposite particles were formed as shown in FIG. 12.

In a fourth operation, the hybrid nanocomposite particles prepared in the third operation were irradiated with neutrons produced in a HANARO that was a laboratory nuclear reactor to radiate Dy, thereby preparing radioisotope Dy@$SiO_2$ nanocomposite particles.

Figure 13:
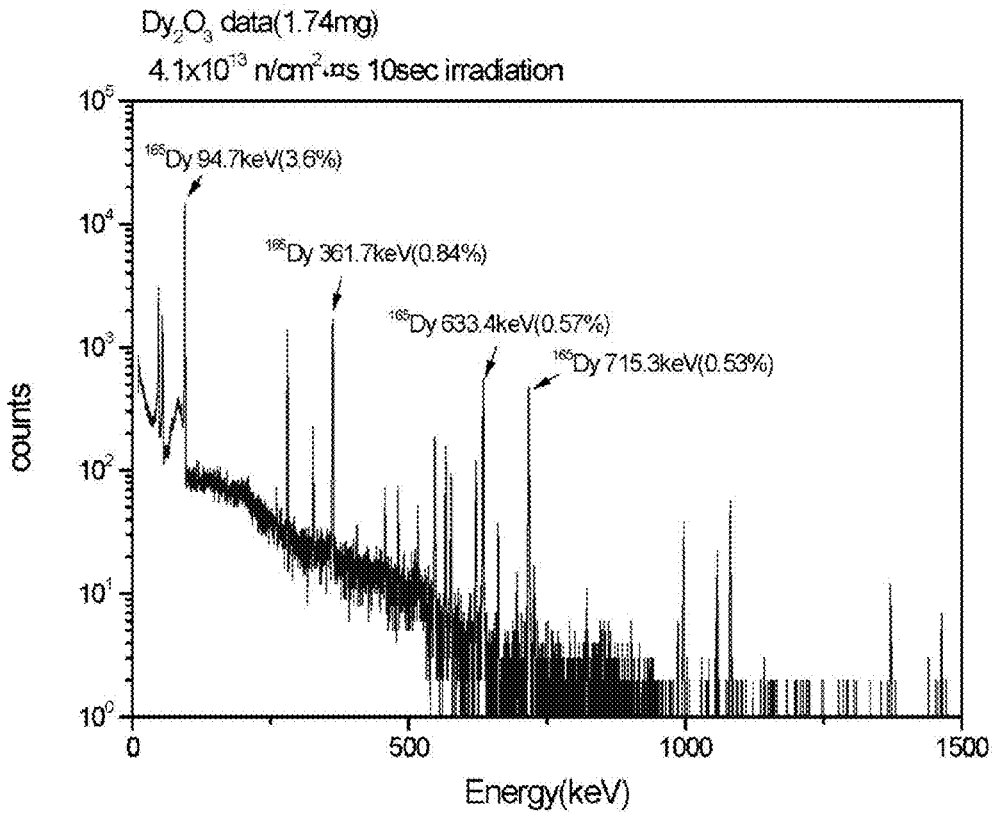
FIG. 13 shows the γ-ray spectra of the radioisotope hybrid $Dy@SiO_2$ nanocomposite particles.

As shown in FIG. 13, the γ-ray spectrum analysis showed that the radioisotope Dy@$SiO_2$ nanocomposite particles had a γ-ray energy of at least 94.7 KeV and up to 715.3 KeV, and that the radioisotope Dy@$SiO_2$ nanocomposite particles were successfully prepared.

The radioisotope hybrid nanocomposite particles according to one exemplary embodiment of the present invention is applicable to all types of radioisotope metals and contains silanol (Si—OH) groups at the surface thereof, and thus serves to introduce various functional groups. Also, the radioisotope hybrid nanocomposite particles can be mass-produced in a simple manufacturing process, and thus can be used as a radioisotope tracer in the fields of oil refining, chemistry, cement, agriculture, water resources, ocean, and the like, used as a diagnostic and therapeutic nanocomposite in the field of medicine, and used as a material for evaluating the risk of nanomaterials.

Further, embodiments of the present invention have an advantage in that the typical processing time can be significantly reduced using a sol-gel process in the preparation of the radioisotope nanocomposite particles. The preparation of the conventional radioisotope nanocomposites has a problem in that a process such as centrifugation takes a long time, but the method according to embodiments of the present invention has an advantage in that it includes a simple manufacturing process of irradiating the nanoparticles with neutrons immediately after preparation of the nanoparticles, thereby reducing the processing time and enhancing the yield.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A method of preparing radioisotope hybrid nanocomposite particles, comprising:

providing at least one reactive compound selected from the group consisting of 3-aminopropyltriethoxy silane and 3-mercaptopropyltriethoxy silane, wherein the at least one reactive compound having an unshared electron pair;

subjecting the at least one reactive compound and a metal ion to a complexization reaction to form a complex molecule in which the metal ion bonds to the reactive compound via the unshared electron pair;

subsequently subjecting the complex molecule and tetraethoxysilane to a sol-gel reaction to produce hybrid nanocomposite particles;

calcining the hybrid nanocomposite particles at 300° C. to 700° C.; and irradiating neutrons to the calcined particles to produce radioisotope hybrid nanocomposite particles.

2. The method of claim 1, wherein subjecting the at least one reactive compound and a metal ion to the complexization reaction comprises mixing in a solvent the at least one reactive compound with a metal-containing compound.

3. The method of claim 1, wherein subjecting the complex molecule and tetraethoxysilane to the sol-gel reaction comprises mixing in a solvent the complex molecule and tetraethoxysilane.

4. The method of claim 3, wherein the solvent comprises ethanol, ammonia and water.

5. The method of claim 4, wherein prior to mixing, the complex molecule is dispersed in the solvent to provide a dispersion, and tetraethoxysilane is added to the dispersion, wherein mixing occurs by stirring for 6-9 Hours.

6. The method of claim 1, wherein calcining continues for 5-10 hours.

7. The method of claim 1, wherein the metal of the metal ion is at least one selected from the group consisting of manganese (Mn), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), yttrium (Yb) and lutetium (Lu).

* * * * *